US007052592B2

(12) United States Patent
Edigaryan

(10) Patent No.: US 7,052,592 B2
(45) Date of Patent: May 30, 2006

(54) CHROMIUM PLATING METHOD

(75) Inventor: Aramayis Edigaryan, Brooklyn, NY (US)

(73) Assignees: Gueguine Yedigarian, Brooklyn, NY (US); Leonid Kuzmin, Brooklyn, NY (US)

( * ) Notice: Subject to any disclaimer, the term of this patent is extended or adjusted under 35 U.S.C. 154(b) by 0 days.

(21) Appl. No.: 10/876,073

(22) Filed: Jun. 24, 2004

(65) Prior Publication Data

US 2005/0284769 A1 Dec. 29, 2005

(51) Int. Cl.
*C25D 3/06* (2006.01)

(52) U.S. Cl. ..... 205/287; 205/289

(58) Field of Classification Search ..... 205/287, 205/289

See application file for complete search history.

(56) References Cited

U.S. PATENT DOCUMENTS

| | | | | |
|---|---|---|---|---|
| 4,359,345 | A * | 11/1982 | Da Fonte, Jr. | 148/266 |
| 4,612,091 | A | 9/1986 | Benaben et al. | 204/51 |
| 5,560,815 | A | 10/1996 | Sekimoto et al. | 205/284 |
| 5,868,917 | A * | 2/1999 | Benaben | 205/109 |
| 6,251,254 | B1 | 6/2001 | Katoh et al. | 205/287 |
| 6,319,385 | B1 | 11/2001 | Mull | 205/104 |
| 2003/0148122 | A1 | 8/2003 | Oshima et al. | 428/472 |
| 2003/0217787 | A1 | 11/2003 | Parkos et al. | 148/255 |

OTHER PUBLICATIONS

Edigaryan et al., "Effect of Fluoride Ions on Chromium Deposition From Sulfuric Acid Solutions of Cr(III)", Protection of Metals, vol. 35, No. 1, c. (no month) 1999, pp. 1-3. Translated From *Zachchita metallov*, vol. 35, No. 1, pp. 5-7.*

* cited by examiner

*Primary Examiner*—Edna Wong
(74) *Attorney, Agent, or Firm*—St. Onge Steward Johnston & Reens LLC

(57) ABSTRACT

An electrolyte bath and method of electrolytically plating a layer of metallic chromium on a substrate comprises providing an electrolyte bath of a trivalent chromium, passing a current through the bath from an anode to a cathode which receives the substrate, maintaining the electrolyte bath at a desired temperature and a desired pH and depositing the trivalent chromium onto the substrate at a desired rate.

15 Claims, 1 Drawing Sheet

CHROMIUM PLATING METHOD

FIELD OF THE INVENTION

The present invention relates to a chromium plating method utilizing trivalent chromium (chromium III). More specifically, the present invention relates to an electrolyte chromium bath and method to achieve both decorative and high impact industrial trivalent chromium plating.

BACKGROUND OF THE INVENTION

Chromium plating is an electrochemical process well-known in the art. There are two general types of chromium plating, hard chromium plating and decorative chromium plating. Hard chromium plating includes application of a heavy coating of chromium onto steel items typically to prevent wear, and exists in thicknesses in the thousandths of an inch (10–1000 μm). Decorative chromium plating applies a much thinner layer of chromium, in millionths of inch (0.25–1.0 μm), providing an extremely thin but hard coating for aesthetic purposes to achieve a shiny, reflective surface and protect against tarnish, corrosion and scratching of the metal beneath.

Chromium plating typical employs hexavalent chromium (chromium VI) a highly toxic material and suspected carcinogen. Use of hexavalent chromium produces hazardous sludge and requires use of expensive chemicals to reduce the waste to a nonhazardous form. Hexavalent chromium also poses an environmental risk as it may escape through spill and leaks and a health risk to individuals working with the material as hexavalent chromium solution is carried by hydrogen gas mist which is generated through the plating process, particular when performing hard chromium plating. As use of hexavalent chromium is problematic for several reasons, trivalent chromium is a desirable alternative with lower waste treatment and air scrubbing costs.

While use of trivalent chromium coatings has become a popular alternative for thin, decorative plating, problems still remain. Trivalent chromium solutions are unstable. Trivalent chromium may be oxidized to hexavalent chromium at the anode which results in an inhibition of the cathode process. Often, anode and cathode must be separated to avoid this problem but in turn this reduces practical use of this method of chrome plating. Trivalent chromium plating is problematic as neutral salts tend to build up in the plating solution and reduce efficiency. These difficulties limit the use of trivalent chromium plating to thin coating applications. While pulse current plating has been employed to obtain thicker layers, it does not produce the desired corrosion-resistant coating.

There remains a need to improve the effectiveness of trivalent chromium plating and to achieve thicker coatings so that it may be employed in wear applications to achieve functional, hard chromium plating, as well as efficient decorative chromium plating.

SUMMARY OF THE INVENTION

The present invention relates to a method of electrolytically plating a layer of metallic chromium on a substrate comprising providing an electrolyte bath of a trivalent chromium, an oxalate, aluminum sulphate, and sodium fluoride, passing a current through the bath from an anode to a cathode which receives a substrate, maintaining the electrolyte bath at a desired temperature and a desired pH and depositing the trivalent chromium onto the substrate at a desired rate.

The present invention relates to a electrolyte bath for trivalent chromium plating comprising a trivalent chromium source, an oxalate, aluminum sulphate, and sodium fluoride, wherein the bath operates at a desired temperature and a desired pH.

DETAILED DESCRIPTION

Figure 1:
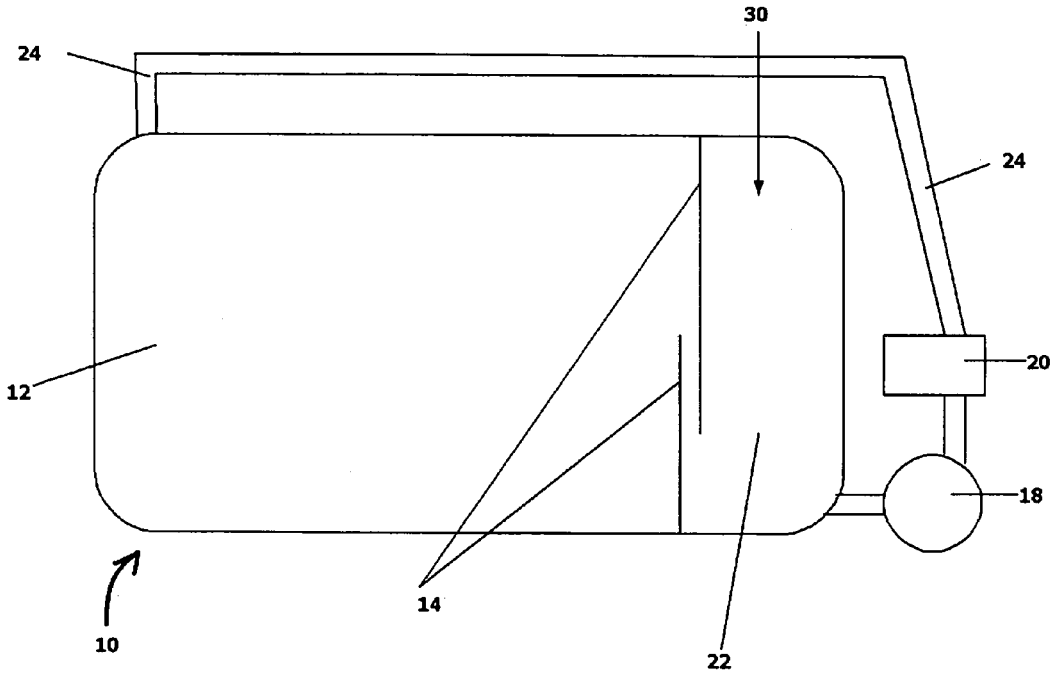
FIG. 1 is a schematic view of one advantageous embodiment of the present invention.

The aforementioned difficulties have been completely eliminated in the present invention. The present invention achieves both decorative and hard plating of trivalent chromium with the advantages of reducing environmental hazards associated with hexavalent chromium and creating a higher level of chrome output which is applicable to both decorative and high-impact industrial hard trivalent chromium plating.

The present invention is based upon the finding that use of particular ligands with chromium III assures stability of the aqueous electrolyte solution and high speed of inter-sphere electron jump, which results in high speed of cathodic reduction from the chromium III complex. The catalytic effect of the ligand increases chrome output and provides for thick plating of metal substrates such as steel, copper, and nickel as well as other metals which are first treated prior to chromium plating. In the chromium plating method of the present invention, preferred ligands are oxalates, specifically potassium oxalate or sodium oxalate.

The aqueous electrolyte bath is prepared in enameled vessel equipped with heating element and mixer, using distilled or deionized water in volume of 40% less than the desired volume of electrolyte. The following components are used to form the bath.

In achieving high-rate industrial hard chromium plating in accordance with the present invention, the electrolyte plating bath preferably comprises:

| | |
|---|---|
| $CrK(SO_4)_2.12H_2O$ | from about 50 to about 500 g/l or |
| $Cr_2(SO_4)_3.6H_2O$ | from about 50 to about 350 g/l; and |
| $Na_2C_2O_4$ or $K_2C_2O_4$ | from about 10 to about 100 g/l, |
| $Al_2(SO_4)_3.18H_2O$ | from about 20 to about 150 g/l, and |
| NaF | from about 5 to about 30 g/l. |

The electrolyte solution most preferably comprises:

| | |
|---|---|
| $CrK(SO_4)_2.12H_2O$ | from about 200 to about 250 g/l or |
| $Cr_2(SO_4)_3.6H_2O$ | from about 130 to about 150 g/l; and |
| $Na_2C_2O_4$ or $K_2C_2O_4$ | from about 30 to about 35 g/l, |
| $Al_2(SO_4)_3.18H_2O$ | from about 100 to about 110 g/l, and |
| NaF | from about 15 to about 20 g/l. |

Preferable operational conditions of the bath to achieve high-rate industrial hard chromium plating include a temperature of from about 40° C. to about 50° C. and most preferably of from about 46° C. to about 48° C. The pH of the electrolyte bath is maintained preferably from about 0.9 to about 2.2 and most preferably from about 1.1 to 1.3. The current density is preferably in the range of i=30–70 A/dm$^2$ and most preferably in the range of i=55–65 A/dm$^2$.

The aforementioned conditions guarantee high-quality chrome-plating at a rate of approximately 3 μm/min, with superior thickness of approximately 100 μm and current efficiency of about 35 to 40%.

In achieving decorative chromium plating in accordance with the present invention, the composition of the aqueous electrolyte solution for the plating bath preferably comprises:

| | |
|---|---|
| $CrK(SO_4)_2.12H_2O$ | from about 50 to about 500 g/l or |
| $Cr_2(SO_4)_3.6H_2O$ | from about 50 to about 350 g/l; and |
| $Na_2C_2O_4$ or $K_2C_2O_4$ | from about 10 to about 100 g/l, |
| $Al_2(SO_4)_3.18H_2O$ | from about 20 to about 150 g/l, and |
| NaF | from about 5 to about 30 g/l. |

The electrolyte solution more preferably comprises:

| | |
|---|---|
| $CrK(SO_4)_2.12H_2O$ | from about 200 to about 250 g/l or |
| $Cr_2(SO_4)_3.6H_2O$ | from about 130 to about 150 g/l; and |
| $Na_2C_2O_4$ or $K_2C_2O_4$ | from about 30 to about 35 g/l, |
| $Al_2(SO_4)_3.18H_2O$ | from about 100 to about 110 g/l, and |
| NaF | from about 15 to about 20 g/l. |

Preferable operational conditions of the bath to achieve decorative chromium plating include temperature of from about 10° C. to about 40° and most preferably of from about 33° C. to about 37° C. The pH is preferably from about 0.9 to about 2.2 and most preferably from about 1.8 to 2.2. The current density is preferably in the range of i=10–50 A/dm$^2$ and most preferably in the range of i=20–30 A/dm$^2$. The aforementioned conditions achieve decorative chromium-plating at a rate of about 0.6–0.7 μm/min.

Thus, the preferable and most preferable components of the electrolyte solution for a high impact industrial chromium plating bath and decorative chromium plating bath of the present invention are of identical ranges. The significant variation between high impact and decorative chromium plating exists in the operating conditions of the bath, specifically the parameters for the pH, temperature and current density. Generally, when operating the bath for plating, whether high rate industrial or decorative, the pH and electricity are adjusted accordingly to one another. Preferably, pH and current density are corresponded to one another according to the following parameters as listed in Table 1.

TABLE 1

| pH | i, A/dm$^2$ |
|---|---|
| 2.2 | 30–35 |
| 1.6 | 40–45 |
| 1.3 | 50–55 |
| 0.9 | 65–70 |

Initially all components of the bath, as set forth above, except for the chromium salt component, are introduced into the vessel and mixed with heat, preferably bringing the temperature of the solution to preferably 92–93° C. After complete dissolution of the aforementioned components, chromium salt, preferably chromium potassium sulphate or chromium sulphate is introduced into the solution and the solution is further mixed with heat for approximately 15–20 minutes. After the solution cools to a temperature of 45–50° C., the pH level is adjusted accordingly as is discussed herein and electrolyte is ready for use in operation of the bath for chromium plating.

Additionally, microparticles may be added to the plating solution to increase the hardness of the plating, increase adhesive features of the coating, and provide higher wear resistance. Preferably, microparticles of diamond, corundum $Al_2O_3$, or silicium carbide SiC, may be used to increase hardness to 1300–1500 units.

It is preferable to utilize chromium potassium sulphate $CrK(SO_4)_2.12H_2O$ as it is less expensive than chromium sulphate $Cr_2(SO_4)_3.6H_2O$ of example 2, and yields the same results of chromium plating. During operation of the bath, the electrolyte is replenished by addition of chromium salt in the bath at appropriate intervals to compensate for its loss to plating. The result of 30 Ah/l of electricity passing through the bath for industrial high rate plating and 100 Ah/l for decorative plating causes a depletion of the trivalent chromium in the electrolyte bath of about 7 g/l that does not significantly affect the efficiency of the process as it only reduces the current efficiency of the electrolyte bath by about 3–5%. As electricity is consumed during operation of the bath and chromium deposited on substrate, the electrolyte solution must be replenished with chromium potassium sulphate or chromium sulphate about every 3 hours, or as determined necessary by continual monitoring of the electricity inputted and the chromium deposited. The electrolyte solution is highly stable and may be utilized for an extended period of time, approximately ten years, before it must be discarded and replaced.

The anode and cathode need not be separated from one another within the bath. Anodes are preferably platinized titanium sheets which prevent undesirable oxidation of trivalent chromium to hexavalent chromium. Such oxidation to hexavalent inhibits plating process. Platinized titanium anodes permit the chromium plating process to occur without separation of the bath into anode and cathode chambers. In the present invention, the anode to cathode ratio is preferably 1:2.

The component NaF serves to increase the current efficiency of the electrolyte bath by approximately 40%.

During operation of the electrolyte bath, the pH of the bath may be regulated. As the bath preferably operates without separate anode and cathode chambers in the bath, the bath electrolyte acidifies during operation. In order to maintain the desired pH level, a base such as sodium hydroxide NaOH or sodium carbonate $Na_2CO_3$ may be added. Preferably, sodium carbonate is added as to form $CO_2$ which promotes electrolyte mixing, and consequently, accelerates the dissolving of formed hydroxides.

The plating process results in the deposition of chrome with 36% of the current efficiency corresponding to the deposit of chromium on the cathode (substrate) and 64% of the current efficiency corresponding to the discharge of hydrogen. On the anode, oxygen is formed. When passing I F of electricity through the bath, the electrode processes are the following:

On the cathode:

$$0.36\ (\tfrac{1}{3}Cr^{+++})+0.36\ F=0.12\ Cr$$

$$0.64\ H^{+}+0.64F=0.\ 32\ H_2$$

On the anode:

$$\tfrac{1}{2}\ H_2O-1F=H^{+}+\tfrac{1}{4}O_2$$

Summarized reaction:

$$0.12\ Cr^{+++}+0.5\ H_2O=0.12\ Cr+0.32\ H_2=0.36\ H^{+}+0.25\ O_2$$

According to the reaction during deposition of 1 mole of chrome (52 g) there forms 3 mole of $H^+$ in the electrolyte or 1.5 mole of $H_2SO_4$, that requires for neutralization 1.5 mole $Na_2CO_3$. Required amount of sodium carbonate is periodically fed into the operational bath via electrolyte circulation chamber. In the result of neutralization of the aforementioned acid there accumulates 1.5 mole of sodium sulphate $Na_2SO_4$ (for the time of precipitation of 1 mole of chrome (52 g)). When amount of the salt reaches peak concentration, that however does not affect normal operation of the bath, it is required to withdraw the salt out of the bath.

The electrolyte bath is constructed of suitable material such as polypropylene or the like. In order to regulate temperature of the bath as needed, the bath is equipped with a pipe made of stainless steel or the like disposed preferably at the bottom of the bath to carry a water supply through the bath. The pipe serves as a heating element, when hot water is passed there through to heat the electrolyte solution as needed or as a cooling system when cold water is passed there through to cool the electrolyte solution as needed. A temperature controller disposed within the bath monitors the hot and cold water supply rate to regulate the electrolyte temperature.

The bath is also equipped with a filter that continual circulates electrolyte through bath. To get complete information on the parameters of the bath, the latter must be equipped with the appropriate monitors to measure electric current intensity, voltage, bath temperature, pH of electrolyte and level of electrolyte in the bath.

Anodes within the bath are made of a suitable material, preferably platinized titanium, in sheets having thickness of about 2–3 mm thickness. The use of platinized titanium sheets permits conduction of chrome plating process without separation of the cathode and anode in separate chambers of the bath and eliminates anode oxidation of chromium III to chromium VI which inhibits plating process.

Anodes may be shaped according to the substrate/product which is being plated to ensure even distribution of cathode current over the surface of the substrate. Substrates are positioned within the bath at the cathode. The cathode (substrate) and anode are disposed within bath at a distance of 30–40 mm. Depending on dimensions and shape of the substrate, a suspension may be constructed and placed within the bath and the substrate fixed thereto. Suspensions are typically constructed from stainless steel and obtained from the appropriate manufacturers.

The bath is equipped with the cover or umbrella for permitting free gas extraction via an on-board ventilation system. The electrolyte solution must be at least 150 mm and preferably 200 mm lower than the upper edge of the bath.

Electric current intensity on the bath is set based on the area of substrate being plated in a given load and on the acceptable precipitation current density for given pH value. The volumic current density should not exceed 10 A/I. Hence, the limit value of current intensity on the bath is $I=I_vV$, when calculating electrolyte volume.

FIG. 1 shows the bath 10 generally including electrolyte solution contained within working part 12 of bath. To begin the plating operation, the working part 12 of bath 10 is filled with the desired amount of electrolyte and the heating element is turned on. When the desired operational temperature is reached, the suspensions with substrate are hung on cathode bars. Precipitation current and the cooling system, equipped with automatic temperature regulator, are turned on. All initial figures, such as electric current intensity, voltage on the bath, pH level, and temperature and electrolyte level in the bath are recorded.

Maintenance of the bath consists in timely replenishment of chromium salt and maintaining desired pH of the electrolyte by means of introduction of a base such as $Na_2CO_3$. Chromium salt and pH regulating base is introduced by injection at 30 through a small chamber 22 at one end of the bath 10. Small chamber 22 is connected to the working part 12 of the bath 10 by means of a special separator 14 which prevents the direct injection into the working part 12 of the bath. There is a constant circulation of electrolyte solution through pipe 24 by way of a pump 18 and filter 20 in order to remove possible impurities. The speed of the circulation is to be determined depending on the volume of the electrolyte.

As acids in the bath are neutralized during operation of the bath, neutral salts, particularly $Na_2SO_4$, accumulate. After reaching a critical concentration of $Na_2SO_4$, typically at 200 g/l, which is reached after approximately 30 hours of operation for high-rate industrial hard chromium plating and 120 hours of operation for decorative chromium plating, desalination must be performed. This periodic extraction of salt by electrolyte cooling prevents supersaturating of the electrolyte. To extract $Na_2SO_4$, electrolyte is poured into separate vessel, where it is cooled to 1–5° C. Cooling causes intensive precipitation of salt. Additionally, $Na_2SO_4$ may be added to cooling electrolyte to accelerate precipitation. Electrolyte is elutriated and subjected to vacuum filtration at the same low temperature. After filtration, the pH of the electrolyte is adjusted to 1.1 and is then returned back into the bath.

The present invention provides an electrolyte bath and plating method utilizing the bath which achieves a fast rate of hard industrial chromium plating, up to 3 μm per minute, which is an environmentally-safe alternative to hexavalent chromium plating. Additionally, the electrolyte bath and plating method are especially useful in chromium plating of "pick-and-place" devices and machines and cylindrical rods, specifically those up to 20 m long and 20–30 cm in diameter which require chromium coatings of a thickness of 80–100 μm and greater. The present invention provides superior results in achieving uniform thickness, when plating uniform complex parts, such as long cylindrical parts.

Also, the present invention provides an electrolyte bath and plating method utilizing the bath which achieves a rate of decorative chromium plating, up to 0,7 μm per minute, which is an environmentally-safe alternative to hexavalent chromium plating. Additionally, the electrolyte bath and plating method are especially useful in chromium plating of parts, with most complex configurations. The present invention provides superior results in achieving uniform thickness when plating complex parts.

A chromium plating bath according to the present invention was prepared accordingly as discussed in the following examples.

Composition of electrolyte solution:

EXAMPLE 1

| | |
|---|---|
| Chromium potassium sulphate $CrK(SO_4)_2.12H_2O$ | 250 g/l |
| Sodium oxalate $Na_2C_2O_4$ | 30 g/l |
| Aluminum sulphate $Al_2(SO_4)_3.18H_2O$ | 110 g/l |
| Sodium fluoride NaF | 20 g/l |

EXAMPLE 2

| | |
|---|---|
| Chromium sulphate $Cr_2(SO_4)_3.6H_2O$ | 150 g/l |
| Sodium oxalate $Na_2C_2O_4$ | 30 g/l |
| Aluminum sulphate $Al_2(SO_4)_3.18H_2O$ | 110 g/l |
| Sodium fluoride NaF | 20 g/l |

The bath is prepared in an enameled vessel equipped with heating element and mixer, using distilled or deionized water in volume of 40% less than the desired volume of electrolyte. Initially all components, as set forth above in Examples 1 and 2, are placed in the bath, except for the chromium salt component, are introduced into the vessel and mixed with heat, preferably bringing the temperature of the solution to preferably 92–93° C. After complete dissolution of the aforementioned components, chromium salt, preferably chromium potassium sulphate or chromium sulphate is introduced into the solution and the solution is further mixed with heat for approximately 15–20 minutes. After the solution cools to a temperature of 45–50° C., the pH level is adjusted accordingly as is discussed herein and electrolyte is ready for use in operation of the bath for chromium plating.

To achieve high-rate industrial, hard chromium plating, electrolyte solution according to example 1 was placed in bath at a temperature of 48° C., pH of 1.2 and current density i=60 A/dm$^2$. The time of deposition was 33 minutes.

To achieve high-rate industrial, hard chromium plating, electrolyte solution according to example 2 was placed in bath at a temperature of 48° C., pH of 1.2 and current density i=60 A/dm$^2$. The time of deposition was 33 minutes.

In both examples 1 and 2, the aforementioned conditions resulted in chromium plating at a rate of plating as follows:

| | Rate of plating | Thickness | Current efficiency |
|---|---|---|---|
| Example 1 | 2.96 μm/min | 97.7 μm | 36.6% |
| Example 2 | 3.1 μm/min | 102 μm | 37% |

When performing decorative chromium plating, the electrolyte according to example 1 was placed in bath at a temperature of 35° C., pH of 2 and current density i=25 A/dm$^2$. The time of deposition was 20 minutes.

When performing decorative chromium plating, the electrolyte solution according to example 2 was placed in bath at a temperature of 35° C., pH of 2 and current density i=25 A/dm$^2$.

In both examples 1 and 2 for decorative plating, the aforementioned conditions resulted in chromium plating as follows:

| | Rate of plating | Thickness | Current efficiency |
|---|---|---|---|
| Example 1 | 0.6 μm/min | 12 μm | 17% |
| Example 2 | 0.63 μm/min | 12.6 μm | 16.4% |

According to all available data, including reflectivity, structure, internal strain and hardness, the trivalent chromium plating electrolyte bath and method of the present invention is identical to that of standard hexavalent chrome electrolyte baths known in the art of, while overcoming the problems that exist in the art. The present invention achieves hardness of the plating of 1000 units (1000 HV/100 g). The addition of microparticles to electrolytic plating solution increases hardness to 1300–1500 units.

What is claimed is:

1. A method of electrolytically plating a layer of metallic chromium on at least one substrate comprising the steps of:

providing a bath with a single chamber having at least one anode and at least one cathode configured to receive at least a portion of a surface of said substrate, said anode and said cathode having a ratio of about 1:2, and containing an electrolyte comprising from about 50 to about 500 g/l trivalent chromium, from about 10 to 100 g/l of an oxalate, from about 20 to about 150 g/l aluminum sulphate, and from about 5 to about 30 g/l sodium fluoride;

passing a current from said anode to said cathode through said electrolyte within said bath;

maintaining a temperature and a pH of said electrolyte;

periodically removing $Na_2SO_4$ by-product from said bath; and depositing said trivalent chromium onto said surface of said substrate.

2. The method of claim 1, wherein said trivalent chromium is chromium potassium sulphate from about 50 to about 500 g/l.

3. The method of claim 2, wherein said electrolyte comprises from about 200 to 250 g/l chromium potassium sulphate, from about 30 to 35 g/l of sodium oxalate or potassium oxalate, from about 100 to 110 g/l aluminum sulphate, and from about 15 to about 20 g/l sodium fluoride.

4. The method of claim 1, wherein said trivalent chromium is chromium sulphate from about 50 to about 350 g/l.

5. The method of claim 4, wherein said electrolyte comprises from about 130 or 150 g/l chromium sulphate, from about 30 to 35 g/l of sodium oxalate or potassium oxalate, from about 100 to 110 g/l aluminum sulphate, and from about 15 to 20 g/l sodium fluoride.

6. The method of claim 1, wherein a hard chromium coating is deposited on said substrate, said current has a density of 30–70 A/dm$^2$, said temperature is from about 40° C. to about 50° C., said pH is from about 1.1 to about 1.3, and said rate of depositing said trivalent chromium on said substrate is of from about 2.8 to about 3.2 μm/min.

7. The method of claim 1, wherein a hard chromium coating is deposited on said substrate, said current has a density of 55–65 A/dm$^2$, said temperature is from about 46° C. to about 48° C., said pH is from about 1.1 to about 1.3, and said rate of depositing said trivalent chromium on said substrate is of from about 2.8 to about 3.2 μm/min.

8. The method of claim 7, wherein said coating has a thickness of at least about 100 μm.

9. The method of claim 1, wherein a decorative chromium coating is deposited on said substrate, said temperature is from about 20° C. to 40° C., said pH is from about 0.9 to about 2.2, and said rate of depositing said trivalent chromium on said substrate is from about 0.6 to about 0.7 μm/min.

10. The method of claim 1, wherein a decorative chromium coating is deposited on said substrate, said temperature is from about 33° C. to 37° C., said pH is from about 1.8 to 2.2, and said rate of depositing said trivalent chromium on said substrate is from about 0.6 to 0.7 μm/min.

11. The method of claim 1, wherein maintaining said pH is achieved by the addition of a base selected from the group consisting of sodium hydroxide or sodium carbonate.

12. The method of claim 1, wherein the step of periodically removing $Na_2SO_4$ by-product from said bath comprises cooling said electrolyte to 1–5° C.

13. The method of claim 1, further comprising the step of replenishing said bath with trivalent chromium at periodic intervals during operation of said bath.

14. The method of claim 1, wherein said at least one anode is made of platinized titanium.

15. The method of claim 1, wherein said electrolyte further comprises microparticles of diamond, corundum, or silicon carbide.

* * * * *